US005144270A

United States Patent [19]

Schedele et al.

[11] Patent Number: 5,144,270

[45] Date of Patent: Sep. 1, 1992

[54] ELECTROMAGNETIC POWER RELAY WITH ACTUATION SLIDE

[75] Inventors: Helmut Schedele, Diessen; Franz Rappl, Feldkirchen Westerham, both of Fed. Rep. of Germany

[73] Assignee: Siemens Aktiengesellschaft, Munich, Fed. Rep. of Germany

[21] Appl. No.: 725,642

[22] Filed: Jul. 3, 1991

[30] Foreign Application Priority Data

Sep. 18, 1990 [DE] Fed. Rep. of Germany ... 9013221[U]

[51] Int. Cl.[5] ..... H01H 51/22

[52] U.S. Cl. ..... 335/80; 335/131; 335/128

[58] Field of Search ..... 335/78-85, 335/124, 128, 131

[56] References Cited

U.S. PATENT DOCUMENTS 4,302,742 11/1981 Schedele .
4,346,359 8/1982 Pirner et al. ..... 335/202
4,602,230 7/1922 Schedele ..... 335/79
4,937,544 6/1990 Mueller .
4,958,137 9/1990 Schroeder ..... 335/128
5,017,898 5/1991 Kuzukawa ..... 335/128

*Primary Examiner*—Lincoln Donovan
*Attorney, Agent, or Firm*—Hill, Van Santen, Steadman & Simpson

[57] ABSTRACT

A relay with a moveable contact element which is actuated through armature movement transmitted via a slide is switched by the application of torsional forces to the movable contact element. The torsional forces are generated by the slide pushing the leaf spring contact element eccentrically in the region of one edge so that twisting of the contact element occurs during the switching event. A lower spring modulus for a spring of predetermined thickness and dimensions result so that a smaller magnetic system and a smaller overall relay is achieved given matching of the spring force curve to the magnetic system force curve.

7 Claims, 1 Drawing Sheet

ELECTROMAGNETIC POWER RELAY WITH ACTUATION SLIDE

BACKGROUND OF THE INVENTION

1. Field of the Invention

The present invention is directed generally to an electromagnetic power relay, and more particularly to a relay having at least one stationary contact element and a movable contact element formed as a leaf spring clamped at one end. A magnetic system having an armature acting on the leaf spring through a slide which is movable generally perpendicular to the extent of the leaf spring displaces the leaf spring from its quiescent position to a working position.

2. Description of the Related Art

A power relay is disclosed in German Published Application 29 12 800 A1 which include a card-shaped slide for operating a contact spring. The slide has an end edge lying parallel to the surface of the contact spring that contacts and pushes against the broad side of a contact spring for actuating the middle contact spring. The contact spring is thus uniformly pivoted about its attachment location.

In power relays having contact springs, the leaf spring material which forms the contact springs must have an adequate cross section to be able to carry the switching current without unwanted overheating. One problem is that a larger spring cross section has a high spring modulus and, thus, is quite stiff. In order to actuate such a stiff spring, particularly a spring of a predetermined length, a larger magnetic system is required. Such larger magnetic system requires a corresponding increase in the switching current, which in turn requires an increase in the spring cross section so that the armature may reliably switch the spring. Therefore, the tendency is to increase the size of the relay as well as the current consumed thereby.

It is universally desired to miniaturized power relays. However, there are limits on miniaturization imposed by the enlargement of the magnetic system and the increase in the spring lengths for the reasons just described.

SUMMARY OF THE INVENTION

It is an object of the present invention to reliably switch a power relay having a prescribed spring cross section and predetermined dimensions of spring length and of the magnetic system.

This and other objects and advantages of the invention are achieved in a relay having a slide which pushes against the broad side of the leaf spring only eccentrically in an edge region of the leaf spring.

As a result of the inventive arrangement of the present device, a leaf spring is asymmetrically actuated so that torsional forces are exerted on the spring during the switching event. Such asymmetrical actuation results in a lower effective spring modulus for a spring of a certain length and cross-sectional area. Compared to a system having a slide which pushes uniformly over the width of the spring, the present device thus may utilize a weaker and smaller magnetic system while nevertheless reliably switching the contact spring. Alternately, given the use of a magnetic system of the same size as in the known relays, less power is drawn by the magnetic system and a magnetic system which is thus more sensitive may be used and driven in an electrically more efficient way. More liberal manufacturing tolerances are also permitted, which results in less expensive manufacturing requirements. As a result of the torsional motion of the spring, the resistance to contact consumption is increased and a larger contact opening is enabled. A further advantage of utilizing torsional motion is that fused contacts are more easily separated. The separation of fused contacts by torsional motion is generally known from European Patent Application 0 326 116 A1.

To further intensify the action of the spring torsion, according to a development of the invention, the contact piece of the contact spring is offset relative to the center axis of the contact spring in a direction away from the actuation location by the slide.

The shape of the slide, in a preferred embodiment, is that of a card or plate having one end facing toward the leaf spring which is formed in an approximately U-shape whereby the two outside legs of the U-shaped end engage into guide cutouts, or notches, in both edge regions of the leaf spring. The center part of the U-shaped slide end pushes the leaf spring only at one side. In an expedient arrangement, the middle portion of the U-shaped slide includes a short actuation section extending parallel to the surface of the leaf spring adjacent one of the outside legs. An edge section which is free of the leaf spring, such as by being cut away from the leaf spring, follows the short actuation section.

BRIEF DESCRIPTION OF THE DRAWINGS

The invention shall be set forth in greater detail below with reference to an exemplary embodiment shown in the drawings, wherein.

DESCRIPTION OF THE PREFERRED EMBODIMENTS

Figure 1:
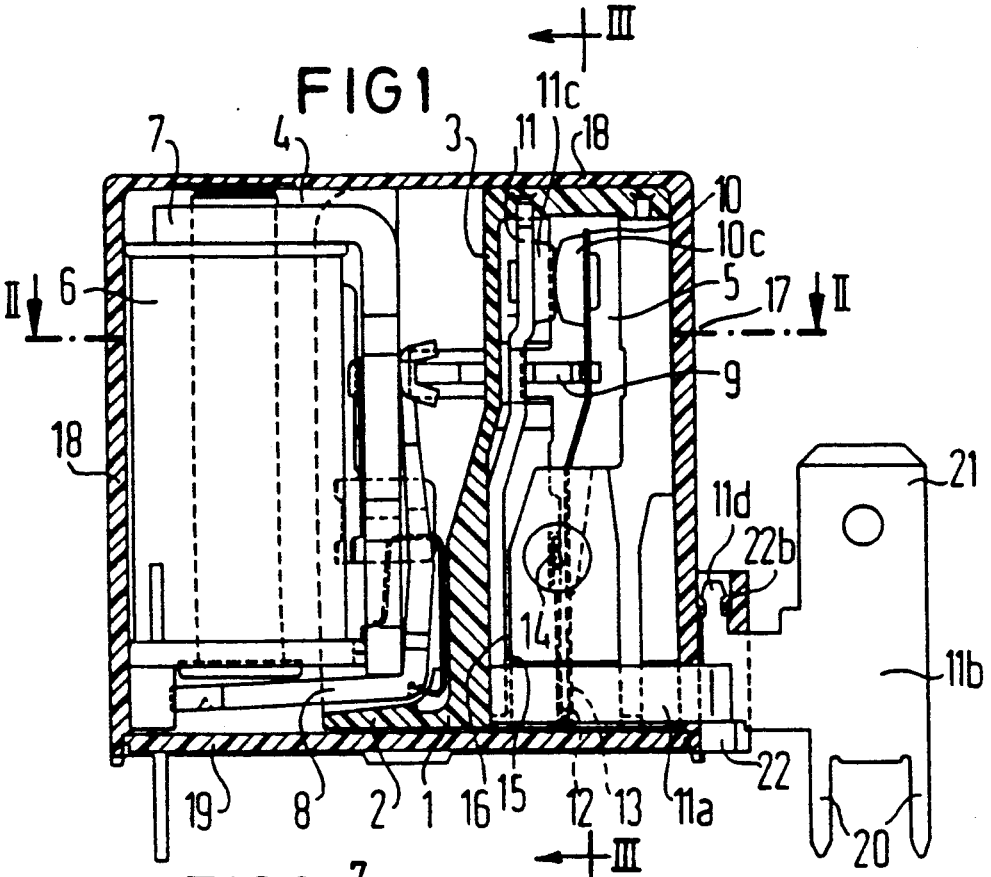
FIG. 1 is a side elevational view, partially in cross section, of a relay according to the principles of the present invention.
Figure 2:
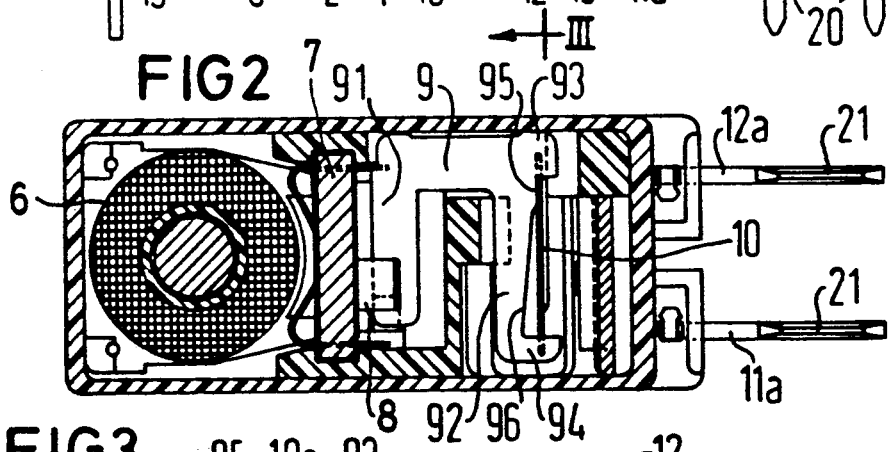
FIG. 2 is a cross section along line II—II of the relay of FIG. 1.
Figure 3:
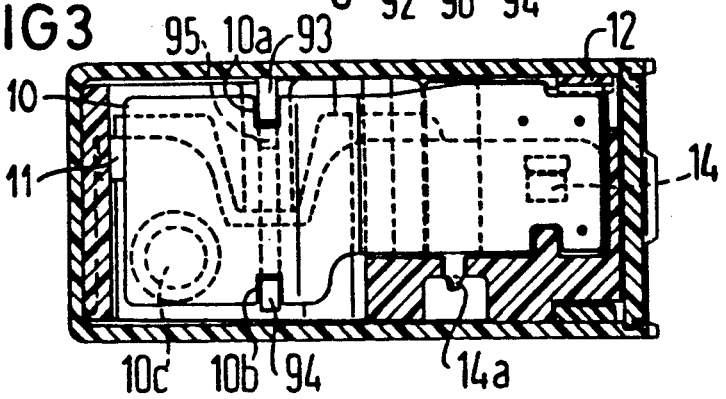
FIG. 3 is a longitudinal cross section generally along line III—III of the relay of FIG. 1.

A relay is shown in FIGS. 1–3 which includes a base member 1 having a bottom part 2 and an essentially perpendicular partition 3 with which a magnetic system space 4 is separated from a contact space 5 in the relay. The magnetic system includes a coil 6, a yoke 7, and an armature 8 in the armature system space. The switch motion of the armature 8 is transmitted to a contact spring, or movable contact, 10 through a slide 9, which will be described in greater detail hereinbelow. The contact spring 10 includes a contact element 10c which works together with a stationary cooperating contact 11 (FIG. 1) or 11' (FIG. 2) having a contact element 11c for selective transmission of electrical energy. The contact spring 10 and the stationary cooperating contact 11 or 11', respectively, are located in the contact space of the relay.

The illustrated example of FIG. 1 is a break-contact relay. Of course, a make-contact relay, as shown in FIG. 2, or a switch-over contact relay may be formed using the same principles by providing a different arrangement of the cooperating contact element relative to the contact spring.

The contact spring 10 is provided with a spring carrier 12 which is plugged into a receptacle slot 13 in the base member 1 proceeding from outside the contact space. The spring carrier 12 is fixed in the base member by a tab 14 clamped in the slot 13 and is also anchored by staggering of a male fastening member 14*a* projecting from said tab 14. The cooperating contact element 11 is plugged into a corresponding receptacle slot 15 in the base member 1 and is anchored by a tab 16. The contact spring 10 and the cooperating contact element 11, thus, each extend essentially perpendicular from the floor of the base member 1 and lie generally parallel to one another with their contacting regions overlapping one another. Insofar as the respective mutual distance from the terminal parts allows, the contact spring 10 and the cooperating contact element 11 extends over a large part of the width of the relay. Thus, the contact element 11 and the contact spring 10 are of a relatively large cross section for carrying high currents. Therefore, the present relay is particularly suited for use as a power relay.

The spring carrier 12 and the cooperating contact element 11 are each merged into a corresponding terminal rail 12*a* or 11*a* in the region of the floor 3 of the base member 1. The terminal rails 12*a* and 11*a* both extend along the outside walls of the base member in the direction of an end face 17 of the relay. The terminal rails, thus, proceed between the base member 1 and the sidewalls of a cap 18 which, together with the base member 1, forms a housing for the relay. For sealing purposes, an additional cover plate 19 is provided at the underside of the relay. Outside the housing, downwardly extending solder pins 20 and upwardly extending flat plugs 21 are provided on the terminal rails 11*a* and 12*a*.

The shape of the slide 9 may be more precisely seen in the sectional view of FIG. 2. The slide 9 is of a plate or card shape which is essentially U-shaped in plan so that it embraces the partition 3. The slide 9, thus, extends through an opening at one side of the partition 3. A first arm 91 of the slide 9 is coupled to the armature 8 while a second arm 92 is in engagement with the contact spring 10. The second arm 92 is itself of an approximately U-shaped profile at its end face. A first, outside leg 93 of the second arm 92 and a second, outside leg 94 each engage into guide cutouts, or notches, 10*a* and 10*b* in either side of the contact spring 10, as shown in FIG. 3. Between the first and second outside legs 93 and 94 at the end of the actuation arm 92, and preferably immediately adjacent the first outside leg 93, is formed a short actuation edge, or contact abutting face 95 which presses against the contact spring 10. An edge portion 96 which is adjacent the actuation edge 95 retreats obliquely backward over its further course toward the second outside leg 94 from the actuation edge 95 and is thereby free of the contact spring 10. This angled back edge 96 enables the contact spring 10 to undergo free torsional movement during pushing of the actuation edge 95 against the contact spring 10. The contact spring, or movable contact, undergoes twisting as it is flexed between its quiescent position and its working position.

In a preferred embodiment, the contact piece 10*c* of the contact piece 11*c* of the cooperating contact 11, is offset from the center axis of the contact spring 10 in a direction away from the actuation edge 95. This enables the action of the spring torsion to bear especially well on the contact pieces 10*c* and 11*c*.

In operation during excitation of the relay, the slide 9 is moved by the armature 8 in the direction toward the contact spring 10. Only the short actuation edge 95, however, comes into engagement with the contact spring 10 so that the contact spring 10 turns, or twists, freely in this region. As a result, the contact piece 11*c* moves a shorter distance than does the slide 9 and a softer spring characteristic, or weaker spring modulus, results. The relay is able to switch reliably even though the magnetic system is designed slighter, or less heavy, than would be required given traditional actuation of the relay. The outside leg 94 and the region 96 of the slide adjacent thereto, thus, have no effect on the actuation of the contact spring 10, but merely serve to guide the slide 9 for movement in its plane via the cutouts 10*a* and 10*b*.

Thus, there is shown and described an electromagnetic power relay having an actuation slide in which the relay has a leaf spring as a movable contact element which is actuated by the armature through a card-shaped slide. The slide pushes the leaf spring eccentrically in an edge region so that the leaf spring is subject to torsion during the switching event. In this way, the force curve of the spring may be optimally matched to the force curve of the magnetic system, so that a smaller magnetic system can be employed compared to traditional actuation of the relay when there are given dimensions of the spring and of the overall relay.

Although other modifications and changes may be suggested by those skilled in the art, it is the intention of the inventors to embody within the patent warranted hereon all changes and modifications as reasonably and properly come within the scope of their contribution to the art.

We claim:

1. An electromagnetic power relay, comprising:

a set of contacts including at least one stationary cooperating contact element and a movable contact element, said movable contact element being a leaf spring clamped at one end relative to its longitudinal extent;

a magnetic system having an armature movable by selective application of electrical energy to said magnetic system; and a slide connected between said armature and said movable contact element by which said armature moves said movable contact element from a quiescent position to a working position, said slide being movable in a direction generally perpendicular to the longitudinal extent of said leaf spring, said slide exerting force on a broad side of said leaf spring only at an edge region of said leaf spring, said slide being card-shaped and an end of said slide facing toward said leaf spring being substantially U-shaped with two outside legs, said substantially U-shaped end of said slide including a short actuation section adjacent one of said two outside legs, said short actuation section being substantially parallel to a surface of said leaf spring, said substantially U-shaped end of said slide also including a free edge section that is free of said leaf spring, said free edge section being adjacent said short actuation section.

2. An electromagnetic relay as claimed in claim 1, wherein said leaf spring has a contact piece, and said contact piece is offset from a center axis of said leaf spring in a direction away from the edge region at which said slide exerts force.

3. An electromagnetic relay as claimed in claim 1, wherein said leaf spring defines guide cut-outs at opposite edges, and said two outside legs of said slide extend into said guide cut-outs, a portion of said slide lying between said two outside legs exerting force on one side of said leaf spring.

4. An electromagnetic relay, comprising:

a relay housing;

a magnetic system in said relay housing including a coil and an armature mounted adjacent said coil for movement upon application of electrical energy to said coil;

a stationary contact mounted in a generally fixed position in said relay housing;

a movable contact of a flexible leaf spring material, said movable contact being anchored at one longitudinal end in said relay housing and having a contact element at a second longitudinal end for selective electrical contact with said stationary contact by flexing of said movable contact wherein said first and second longitudinal ends are at opposite ends of said movable contact, said movable contact having a lateral extent that is generally perpendicular to an axis extending between said first and second longitudinal ends; and a slide extending between said armature and said movable contact to transmit motion of said armature to said movable contact and thereby move said contact element into and alternately out of electrical contact with said stationary contact, said slide exerting moving force on said movable contact only at one side of said lateral extent, an end of said slide adjacent said movable contact being U-shaped with two endwardly extending legs, said two endwardly extending legs being on either lateral side of said movable contact.

5. An electromagnetic relay as claimed in claim 4, wherein said movable contact includes two notches formed into opposite lateral sides thereof, and wherein said two endwardly extending legs of said slide lie in respective ones of said two notches.

6. An electromagnetic power relay, comprising:

a relay housing;

a magnetic system in said relay housing including a coil and an armature mounted adjacent said coil for movement upon application of electrical energy to said coil;

a stationary contact mounted in a generally fixed position in said relay housing;

a movable contact of a flexible leaf spring material, said movable contact being anchored at one longitudinal end in said relay housing and having a contact element at a second longitudinal end for selective electrical contact with said stationary contact by flexing of said movable contact wherein said first and second longitudinal ends are at opposite ends of said movable contact, said movable contact having a lateral extent that is generally perpendicular to an axis extending between said first and second longitudinal ends, said movable contact including two notches formed into opposite lateral sides thereof; and a slide extending between said armature and said movable contact to transmit motion of said armature to said movable contact and thereby move said contact element into and alternately out of electrical contact with said stationary contact, said slide having an end adjacent said movable contact which is u-shaped with two endwardly extending legs, said two endwardly extending legs extending into respective ones of said two notches, said slide includes a contact abutting end face disposed between said two endwardly extending legs, said contact abutting end face having an extent substantially less than said lateral extent of said movable contact, said contact abutting end face of said slide striking said movable contact only adjacent one lateral edge of said movable contact and thereby exerting moving force on said movable contact only at one side of said lateral extent of said movable contact.

7. An electromagnetic power relay, comprising:

a relay housing;

a magnetic system in said relay housing including a coil and an armature mounted adjacent said coil for movement upon application of electrical energy to said coil;

a stationary contact mounted in a generally fixed position in said relay housing;

a movable contact of a flexible leaf spring material, said movable contact being anchored at one longitudinal end in said relay housing and having a contact element at a second longitudinal end for selective electrical contact with said stationary contact by flexing of said movable contact wherein said first and second longitudinal ends are at opposite ends of said movable contact, said movable contact having a lateral extent that is generally perpendicular to an axis extending between said first and second longitudinal ends; and a slide extending between said armature and said movable contact to transmit motion of said armature to said movable contact and thereby move said contact element into and alternately out of electrical contact with said stationary contact, said slide exerting moving force on said movable contact only at one side of said lateral extent, an end of said slide adjacent said movable contact being U-shaped with two endwardly extending legs, said two endwardly extending legs being on either lateral side of said movable contact, an edge portion between said two endwardly extending legs lying at an oblique angle to an unflexed lateral extent of said movable contact, said edge portion causing a twisting of said movable contact as said slide exerts moving force on said movable contact.

* * * * *